US005636764A

United States Patent [19]

Bonerb

[11] Patent Number: 5,636,764

[45] **Date of Patent: *Jun. 10, 1997**

[54] FLEXIBLE BULK CONTAINER APPARATUS AND DISCHARGE METHOD

[76] Inventor: Timothy C. Bonerb, P.O. Box 2645, Conway, N.H. 03818

[ * ] Notice: The term of this patent shall not extend beyond the expiration date of Pat. No. 5,344,048.

[21] Appl. No.: 422,628

[22] Filed: Apr. 14, 1995

Related U.S. Application Data

[63] Continuation of Ser. No. 300,150, Sep. 2, 1994, abandoned, which is a continuation of Ser. No. 62,426, May 17, 1993, Pat. No. 5,344,048.

[51] Int. Cl.[6] ..... B65D 35/28

[52] U.S. Cl. ..... 222/95; 222/105; 222/166; 383/2; 383/67; 383/120; 383/906

[58] Field of Search ..... 222/95, 105, 166, 222/181, 185, 386.5, 389, 528; 383/2, 24, 67, 120, 906

[56] References Cited

U.S. PATENT DOCUMENTS

| | | | |
|---|---|---|---|
| 4,480,766 | 11/1984 | Platt | 383/24 X |
| 4,527,716 | 7/1985 | Haas et al. | 222/181 X |
| 4,691,371 | 9/1987 | Derby | 383/906 X |
| 4,722,655 | 2/1988 | Bonerb | 414/288 |
| 4,728,004 | 3/1988 | Bonerb | 222/389 X |
| 4,811,419 | 3/1989 | Derby | 383/906 X |
| 4,854,801 | 8/1989 | Bonerb . | |
| 4,861,215 | 8/1989 | Bonerb | 414/288 |
| 4,911,562 | 3/1990 | Mazzeschi | 383/906 X |
| 4,946,290 | 8/1990 | Matyja | 383/120 X |
| 5,029,734 | 7/1991 | Nichols | 222/105 |
| 5,344,048 | 9/1994 | Bonerb | 222/105 |

FOREIGN PATENT DOCUMENTS

| | | | |
|---|---|---|---|
| 2014965 | 9/1979 | United Kingdom | 222/528 |

OTHER PUBLICATIONS

Brochure, Taylor Products Company for Bulk Bag Discharger and Deweigher.

Brochure, Metalcraft Company for Transtore Discharge Station.

*Primary Examiner*—Gregory L. Huson
*Attorney, Agent, or Firm*—Phillip E. Decker

[57] ABSTRACT

A discharge bulk bag that increases the efficiency for handling, storing, transporting and discharging dry materials in intermediate bulk containers. When filled with dry bulk material, the bulk bag can be easily moved about, transported or stored. A flexible discharge spout is located on the bottom side of one of the walls of the bag. At the time of discharge, the bag is positioned on the unloader and the spout is unfolded from its stowed position by releasing one of the restraint straps. The outlet opening at the end of the discharge spout is then connected to a receptacle opening. By releasing the bottom most restraint strap, the spout section opens up—allowing the bulk material inside to flow. The bulk material will continue to flow until it reaches a static condition, at which time the platform of the unloader begins to incline—dumping the remaining material in the bag towards the outlet opening. The flow from the bag is facilitated by a platform that provides an inflatable bladder that can incline the support platform, dumping the material towards the discharge spout and receptacle. The lifting platform is inclined by using low pressure air (1–2 PSI) to inflate the air bag positioned between the lifting platform and the unloader's base frame. Vertical supports are located on the base frame and lifting platform to hold the bulk bag in place during the discharge or unloading cycle. The platform can also be adapted by eliminating the vertical supports so that it can used directly from a standard fork lift truck.

22 Claims, 9 Drawing Sheets

FLEXIBLE BULK CONTAINER APPARATUS AND DISCHARGE METHOD

This application is a continuation of application Ser. No. 08/300,150, filed Sep. 2, 1994, now abandoned, which in turn is a continuation of application Ser. No. 08/062,426, filed May 17, 1993, now U.S. Pat. No. 5,344,048.

BACKGROUND OF THE INVENTION

1. Field of the Invention

The invention relates to an apparatus and method for handling, storing, transporting and discharging dry materials in intermediate bulk containers.

2. Description of the Related Art

For many processors of dry bulk materials, it isn't practical nor feasible to make use of conventional silos to store and deliver raw materials. Local zoning ordinances restricting a silo's height, lack of suitable outdoor space, or a facility that is leased make it necessary to handle their raw materials in containment bags coming in a variety of capacities and styles. Capacities typically range from 10 to 100 cubic feet. Filling options on currently available bags are open tops, inlet tops and duffle tops. Discharge options are plain bottom, conical bottom spouts, cylindrical bottom spouts, and even a combination side/bottom discharge chute. The typical bag has a capacity of 1,500 to 2,500 pounds, with dimensions 40" by 40" by 40". These bags are filled from the top and emptied from the bottom in the same manner as conventional silos. Like conventional silos, the bulk bags suffer from the same problems. During transporting from the vendor to the customer, the dry bulk material may compact from the constant vibration and as a result, may not discharge properly from the bag. Some materials are naturally resistant to flow. When attempting to empty the bags, the material can bridge over the bottom discharge opening interfering with the emptying of the bag. The material can also "rat hole", that is, form a hole from the discharge opening to the top of the bag which stops further material from flowing. Vibrators, massagers and rollers help to reduce the problems but for some materials, such as cocoa, difficulties still remain. A reliable dry material bulk bag and discharge apparatus and method, capable of handling all materials is not found in the prior art.

SUMMARY OF THE INVENTION

It is the object of the invention to provide a side-discharge bulk bag and unloading apparatus and method that will discharge dry materials that are inherently poor-flowing or have become so during handling.

It is another object of the invention to provide an apparatus and method for handling dry bulk materials that reduces the head pressure over the discharge opening.

It is still another object of the invention to provide an apparatus and method for handling dry bulk materials that allows a more efficient lateral-downward material flow.

Another object of the invention is to provide an apparatus and method for handling dry bulk materials that reduces the problems created by the material compacting and caking before or during discharge.

It is a further object of the invention to provide an apparatus and method for handling dry bulk materials that requires less headroom.

Another object of the invention is improve the safety of the bulk discharge operation since current methods require the operator to reach under a very heavy suspended bag.

It is another object of the invention to provide a side-discharge bulk bag that can be connected by the operator by unfolding the spout from the side.

It is still a further object of the invention to provide an apparatus and method for handling dry bulk materials which is more sanitary by protecting the material from the introduction of foreign matter during discharge.

It is the object of the invention to provide a side-discharge bulk bag and unloader that allows many bags to be staged on a similar platforms for unloading without the need of a fork truck for changing.

It is a final object of the invention to provide an apparatus and method that needs little or no modifications to handle a wide variety of materials.

The invention is a dry bulk containment bag. It comprises a polyhedral shape having substantially planar top and bottom panels and at least one side panel connected between said top and bottom panels. The panels are constructed from a flexible material selected in accordance with the dry bulk material to be contained herein. The top panel has a closable opening through which said apparatus is filled with the dry bulk material. Means for discharge attached to said side panel adjacent to said bottom panel are provided, wherein said means for discharge represents at least 10% of the total volume of said bag.

DETAILED DESCRIPTION OF THE INVENTION

In accordance with the present invention, a bulk container bag for storing and handling dry material includes a top fill opening through which material is introduced into the bulk bag, and a discharge spout located at the bottom of a side wall of the bag through which the material is discharged. When the bulk bag is filled, the discharge spout is folded and secured to the sidewall of the bag by flexible restraints. For discharging the material, the bulk bag is positioned on the unloader's lifting platform. The restraints holding the spout in a folded and secured position are released, allowing the spout to be unfolded and connected to a receptacle. Once the spout's end is secured to the receptacle, another bottom restraint is released, allowing the material to flow through the discharge spout section of the bulk bag to the receptacle. An intermediate spout connection is secured to the platform or the hopper and the discharge spout. When the platform is inclined, the intermediate spout flange also moves preventing any bunching up of the spout section. It is also possible that instead of an intermediate spout section, rings or other means are located on the bag and pulled by the use of a cord to collect the slack of the spout section.

One or more added restraints used to hold extra fabric in a folded position in the pleat area of the side panel and discharge spout may also be released to further open and enlarge the bulk bag, helping the material to un-compact and become more free-flowing. A rigid closure assembly may be used on the discharge spout. This may make the hook-up of the spout to the unloader hopper easier for the operator. It may also provide a more sanitary and dust-free method of closing and opening the bag. As the material in the bulk bag reaches its angle of repose and/or otherwise becomes static, the unloader's lifting platform inclines, dumping the material towards the discharge spout and receptacle. The lifting platform is inclined by using low pressure air (1–2 PSI) to inflate the air bag positioned between the lifting platform and the unloader's base frame. Vertical supports are located on the base frame and lifting platform to hold the bulk bag in place during the discharge or unloading cycle. An adjustable, rigid pan section is used to support the bulk bag's discharge spout between the lifting platforms hinged side and the receptacle.

Figure 1:
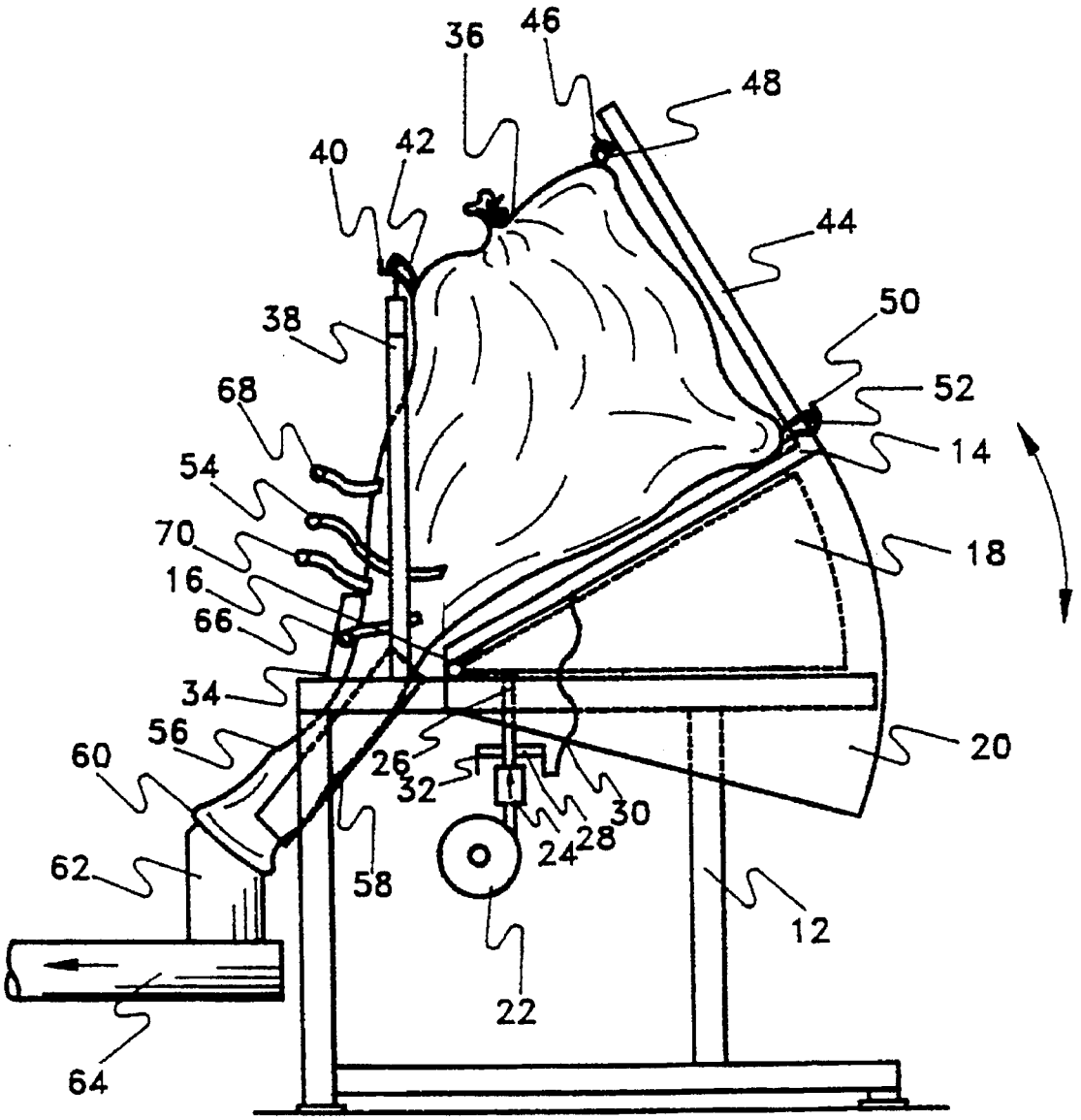
FIG. 1 is a side view of bulk bag apparatus and unloading apparatus according to the invention.

FIG. 1 is a side view—showing the side-discharge bulk bag 36 positioned on the lifting platform 14 during the dumping or unloading cycle. The unloader is shown positioned on a floor. Preferably, it will be secured to the floor, providing an added level of safety. The base frame 12 provides support and maintains proper alignment under the lifting platform 14 by the use of a hinge 16. The addition of steps, railings, guards and handles (not shown) well known in the art could be added for operator convenience and safety.

Between the base frame 12 and lifting platform 14, an air bag 18 is positioned to provide the tilting action of system. As the air bag 18 is inflated with low pressure air, the lifting platform 14 pivots upward and inclines.

Attached to the three non-hinged sides of the lifting platform 14 is a protective cover 20 which provides a safety enclosure for the air bag 18. Cover 20 is an optional feature. Lifting 14 could be built without cover 20. During the entire operation of the unloader, the protective cover 20 will totally enclose the space between the base frame 12 and lifting platform 14 where the air bag 18 is positioned.

A small, fractional horse-power blower 22 provides the 1–2 psi of air pressure required to operate the system.

Between the air bag 18 and blower 22, a one way check valve 24 is used to hold pressure in the air bag 18 so it does not deflate during the unloading process. An air line 26 connects the blower 22, check valve 24 and air bag 18 together. Also included in the air line 26 between the check valve 24 and the air bag 18 is an automatically controlled exhaust valve 28 and a manually controlled exhaust valve 32. A flexible or rigid type of linkage 30 is connected to the automatic valve 28 and the lifting platform 14.

As the lifting platform 14 inclines to the maximum desired angle, the linkage moves the lever of the automatic exhaust valve 28 to an open position limiting the dump angle and allowing the air bag 18 to deflate, returning the lifting platform 14 to a horizontal position. This action also turns the blower 22 off so it can inflate during the deflation process. Valve 28 could also be designed as a relief valve for exhausting the air, thereby limiting the incline angle of platform 14. It could be designed to automatically employ and be kept open to fully deflate the air bag 18. It could also be designed to be manually operated, thus allowing the operator to deflate air bag 18 as desired.

Alternatively, lifting platform 14 could be raised and lowered using hydraulics, air cylinders, screw-type linear actuators in place the air bag 18 and blower 22.

As shown, the side discharge bulk bag 36 is positioned on the lifting platform 14. As the level sensor 34 monitors the level of material in the bag, it will routinely turn on and off the blower 22, dumping material as required during the unloading cycle. Any number of different types of switches such as probes, mercury switches, electric eyes, mechanical switches, radio frequency, limit switches or others well known in the art may be used to monitor the material to make sure an uninterrupted flow of material is supplied to the receptacle 62 and conveyor 64. Other types of conveying equipment such as feed screws or a rotary air lock could be added to the unloading system depending on the requirements of the user.

An alternative embodiment of the unloading system would be to enable lifting platform 14 to incline less than the horizontal before climbing to the maximum dump angle. This may be helpful in keeping material from entering the side-discharge spout before it is connected to receptacle 62. It may also assist in slowing the amount of material that is flowing through the spout where too high a flow rate could result in the spout of bag 36 becoming clogged and stopping flow.

The unloading system described herein is also suitable for use in unloading rigid bins. A deflation cycle would be added to system when using rigid bins so that platform 14 could be gently lowered or held at a desired angle rather than letting it fall under the weight of the empty rigid bin or move forward due to the change in the empty bin's center of gravity.

To hold the bulk bag 36 in the proper position during the dumping or unloading cycle, a vertical support structure 38 with adjustable hooks 40 or any other suitable restraint hold the bulk bags lifting loops 42 in place, maintaining the bulk bag 36 in an open and upright position. The vertical support structure 38 is secured to the base frame 12 near the hinged side of the lifting platform. The two lifting platform supports 44 are secured to both of the back corners of the lifting platform 14 and also and provide support for the bulk bag 36. At or near the top of the lifting platform supports 44 are hooks 46 that hold the back lifting loops 48. On the bottom of the back side of the bulk bag 36 (across from the discharge spout) are bottom loops 52 that are held in position by hooks 50. It is also possible to use bag support posts which can be attached to the incline platform and angle forward as the bag inclines.

Restraint straps 54 are used to hold the discharge spout 56 in a folded and secure position when not in use. While only one pair is shown, for average weight materials, several pairs are required. The restraint straps 54 are located on approximately 5" centers along the pleated area. Fewer straps are required for lightweight materials and more straps may be required for heavier materials.

At the time of unloading, the restraint strap 56 is released allowing the discharge spout 56 to be unfolded and connected to the receptacle 62. To provide support for the discharge spout 56 an adjustable rigid pan 58 may be used between the hinged area of the base frame 12 and the receptacle 62. Once the discharge spout outlet 60 is connected to the receptacle 62, the last restraint strap 66 is released, allowing the material inside the bag to flow through the discharge spout 56 section of the bag to the receptacle 62.

Added restraint straps 68 and 70 may also be used and released to open up pleated area 56 on the bulk bag's 36 sides and discharge spout 56 area. Pleated area 56 may extend from the very top of the sidewall of the bag all the way down to the end of the spout. As pleat 84 opens up and enlarges, more room is created in the bag. This allows the material to un-compact and return to a more flowable condition. As a general rule, more efficient flow, the extra material being folded in the pleat area should increase the volume of the bag by 10 and 60 percent.

Figure 2B:
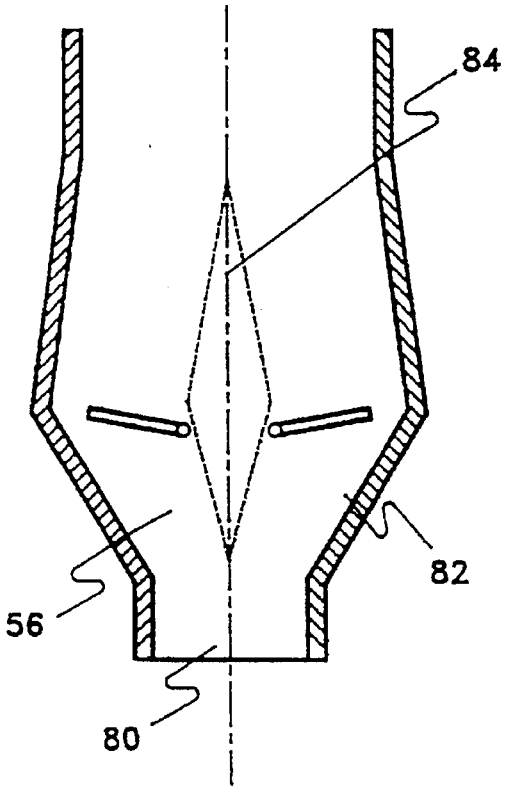
FIG. 2B is a detailed view of the front panel of the bulk bag apparatus.
Figure 2A:
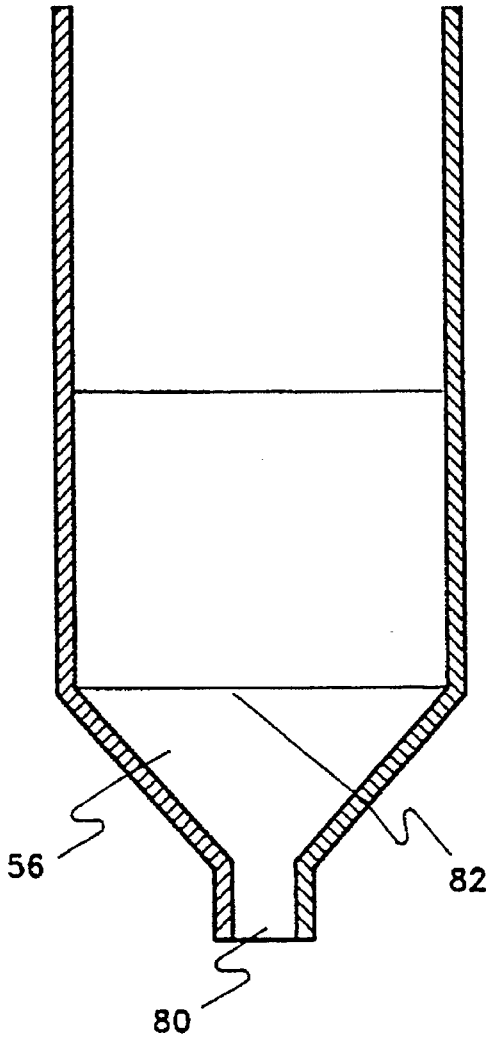
FIG. 2A is a detailed view of the back panel of the bulk bag apparatus showing the back, floor and spout.
Figure 2:
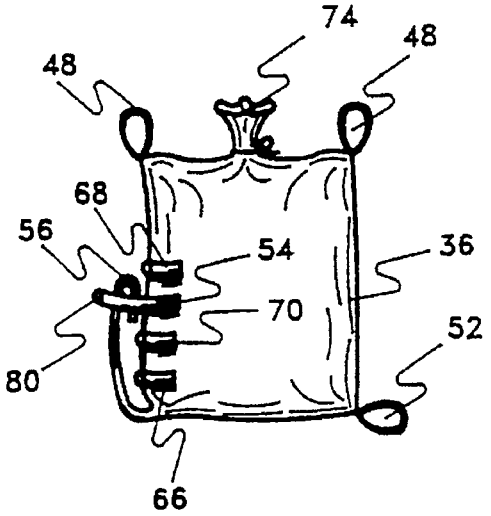
FIG. 2 is a side view of the bulk bag apparatus in a closed position according to the invention.

FIG. 2 is a side view of the bulk bag 36 shown with the discharge spout 56 in a folded and stowed position. The lifting loops 48 are positioned at the various top locations of the bulk bag 36. They may be used for lifting the bag 36 as well as securing the bag 36 to the unloader frame. The bottom restraint loops 52 are positioned on the back side of the bulk bag 36 opposite the discharge spout 56. There function is to hold the floor section of the bulk bag 36 in an open and flat position during the dumping cycle. If the back of the bag was not secured, it might slide on the lifting platform towards the discharge spout 56 and cause problems. Restraint strap 54 is used to hold the discharge spout 56 in a folded position. The restraint strap 54 is made of polyester or nylon webbing with simple plastic end clips (similar to the kind used on back packs) that are attached to the connecting ends with the other ends of the restraint strap 54 secured (sewn) to the bulk bag 36. Restraint strap 66 is shown at the bottom of the bag. Its function is to hold the bottom of the bag in and not let any bulk material in to the discharge spout 56. Restraint straps 68 and 70 are used to hold in the added fabric in the pleat 84 section of the bag. On top of the bag is the fill opening 74.

Bulk bag 36 can be made larger than standard bulk bags since the ease of handling and discharge efficiency makes the increase in size attainable. One method of fabricating the bag to produce a finished product 40" by 40" by 48" high, capable of storing 45 cubic feet of material, is to use two side panels 40" by 48"; a top panel 40" by 40"; another panel comprising the back, bottom and part of the spout 56, as shown in FIG. 2*a* and a final panel, as shown in FIG. 2*b*, which forms the front panel with a pleat 84 and the remaining portion of the spout. As shown in FIGS. 2*a* and 2*b*, the spout exit 80 is considerably smaller than the entrance 82. However, the bag could also be designed so the spout exit 80 is the same as or only slightly smaller than the entrance 82 to achieve "big mouth" embodiment for rapidly emptying the bulk bags. Note that the use of one or more pleats is optional and the bulk bags may not always require such pleats depending on the flow characteristics of the dry bulk material being stored.

The actual layout of the bag panels depends on the size of the bulk bag and the width of the material used in the fabrication so that cutting waste can be minimized. Suitable materials for constructing the bulk bag 36 are vinyl, woven polypropylene, or other woven and non-woven fabrics depending on the strength required and dry material that is to be contained.

Figure 3:
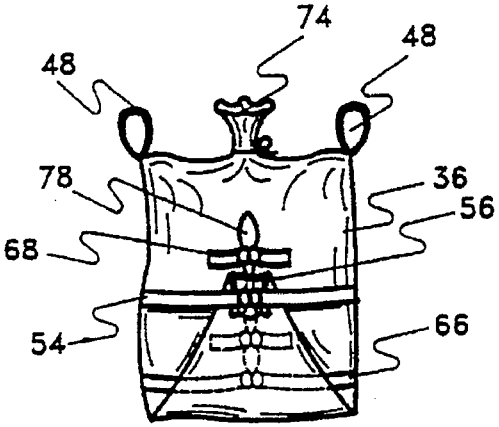
FIG. 3 is a front view of the bulk bag apparatus in a closed position according to the invention.

FIG. 3 is a front view of the bulk bag 36 with the discharge spout 56 in a folded and secured position. All of the restraint straps 54, 66, 68 and 70 are connected.

Figure 4:
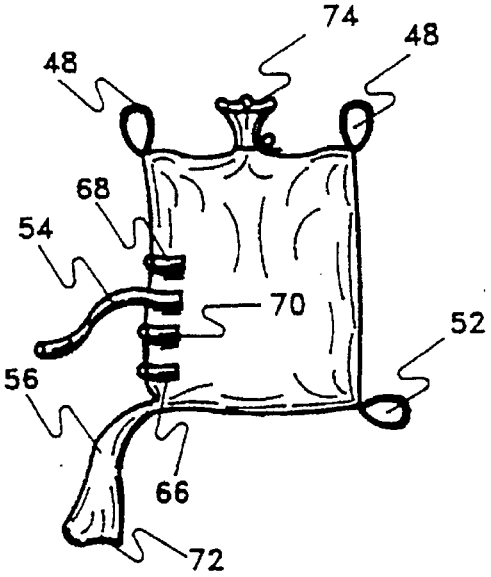
FIG. 4 is a side view of the bulk bag apparatus in an open position according to the invention.

FIG. 4 is a side view of the bulk bag 36 with the discharge spout 56 unfolded. By releasing restraint strap 54, the discharge spout 56 is easily unfolded and ready to be secured to a receptacle. At this time, restraint strap 66, holds the bottom of the bag secure, not allowing the material to flow into the discharge spout 56. Restraint straps 68 and 70 are also fastened together, holding in the material in the bulk bag 36. The restraint mechanism described herein may be a separate part of the bag and not a section of the discharge spout. It may be an added flap or harness assembly sewn to the bag.

Figure 5:
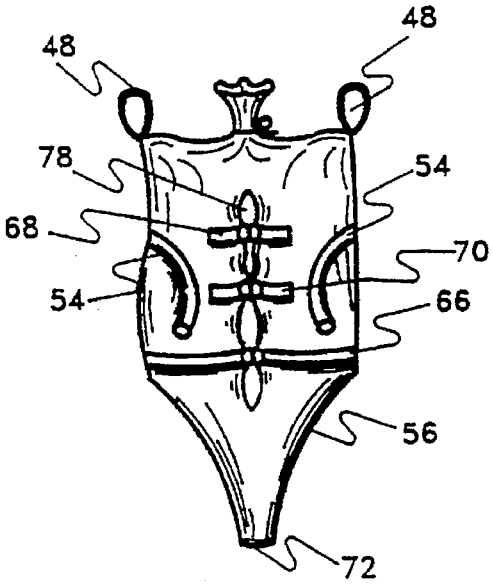
FIG. 5 is a front view of the bulk bag apparatus in an open position according to the invention.

FIG. 5 is a front view of the bulk bag in the same position as FIG. 4. Again, restraint strap 54 has been released while restraint straps 68 and 70 remaining in place, preventing the material within bag 36 from flowing from outlet end 72.

Figure 6:
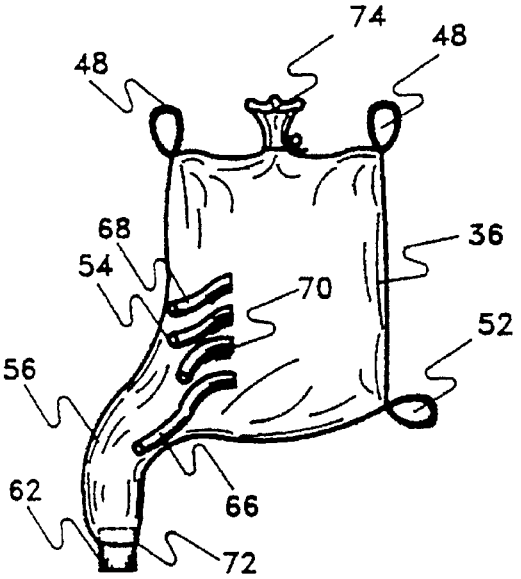
FIG. 6 is a side view of the bulk bag apparatus during the unloading cycle according to the invention.

FIG. 6 is a side view of the bulk bag 36 during the unloading cycle. With the outlet 72 of the discharge spout 56 now connected to the receptacle 62, restraint strap 66 is unfastened, allowing the material to flow into the discharge spout 56. Also, in an added effort to help un-compact the material inside the bulk bag 36, the restraint straps 68 and 70 are also unfastened—allowing the extra fabric in the pleat 78 to expand—creating even more room in the bag for the material to expand. Pleat 78 could be fastened by any suitable means such as hook and loop fasteners (Velcro®), rope through eyelets (grommets), draw strings, plastic fasteners and other fastening means well known in the art.

Figure 7:
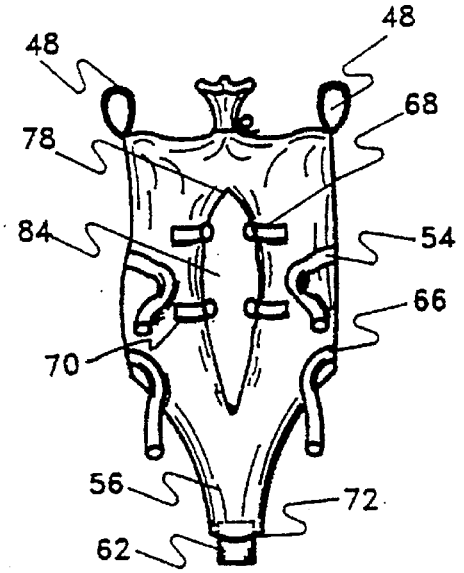
FIG. 7 is a front view of the bulk bag apparatus during the unloading cycle.

FIG. 7 is a front view of the bulk bag 36 during the unloading cycle. The bag is shown with all of the restraint straps 54, 66, 68 and 70 released or unfastened. Pleat 78 is shown in its full open position.

Figure 8:
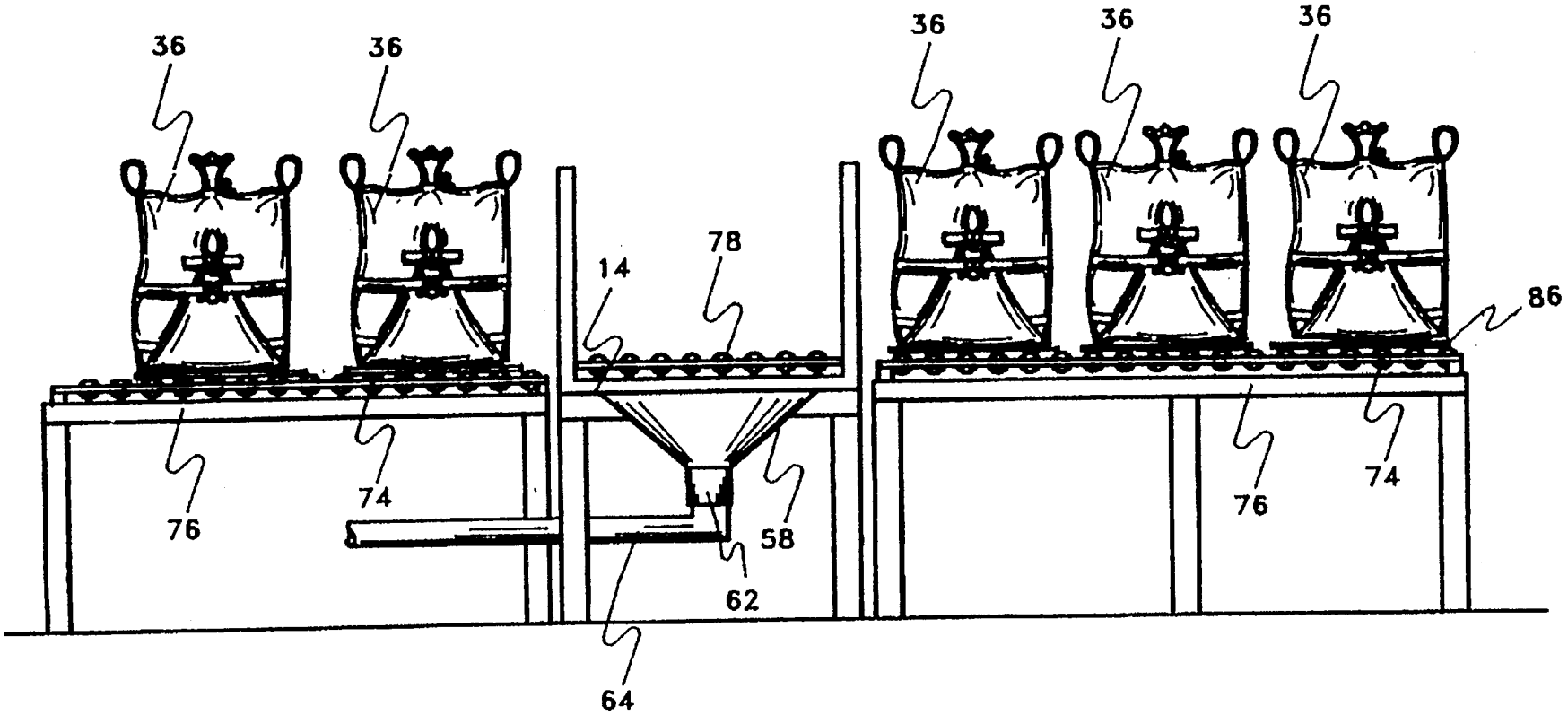
FIG. 8 illustrates the bulk bag apparatus in an conveyor unloading operation according to the invention.

FIG. 8 illustrates the bulk bag apparatus in an conveyor unloading operation according to the invention. Bulk bags 36 are loaded onto the staging unit conveyors 76. In this way, the fork lift can load a number of bags at one time and then is free to do other tasks rather than be held hostage as is required in a one by one unloading method. Conveyors 74 can be adjusted to provide a slight slope towards lifting platform 14 so that bags 36 will move along rollers 74 with little or no external effort required. Once a bag 36 is adjacent to the lifting platform 14, it is slid onto rollers 78 and unloaded as shown in FIG. 1. Rigid sheets 86 may be placed under bags 36 to facilitate their movement along rollers 74.

Figure 9:
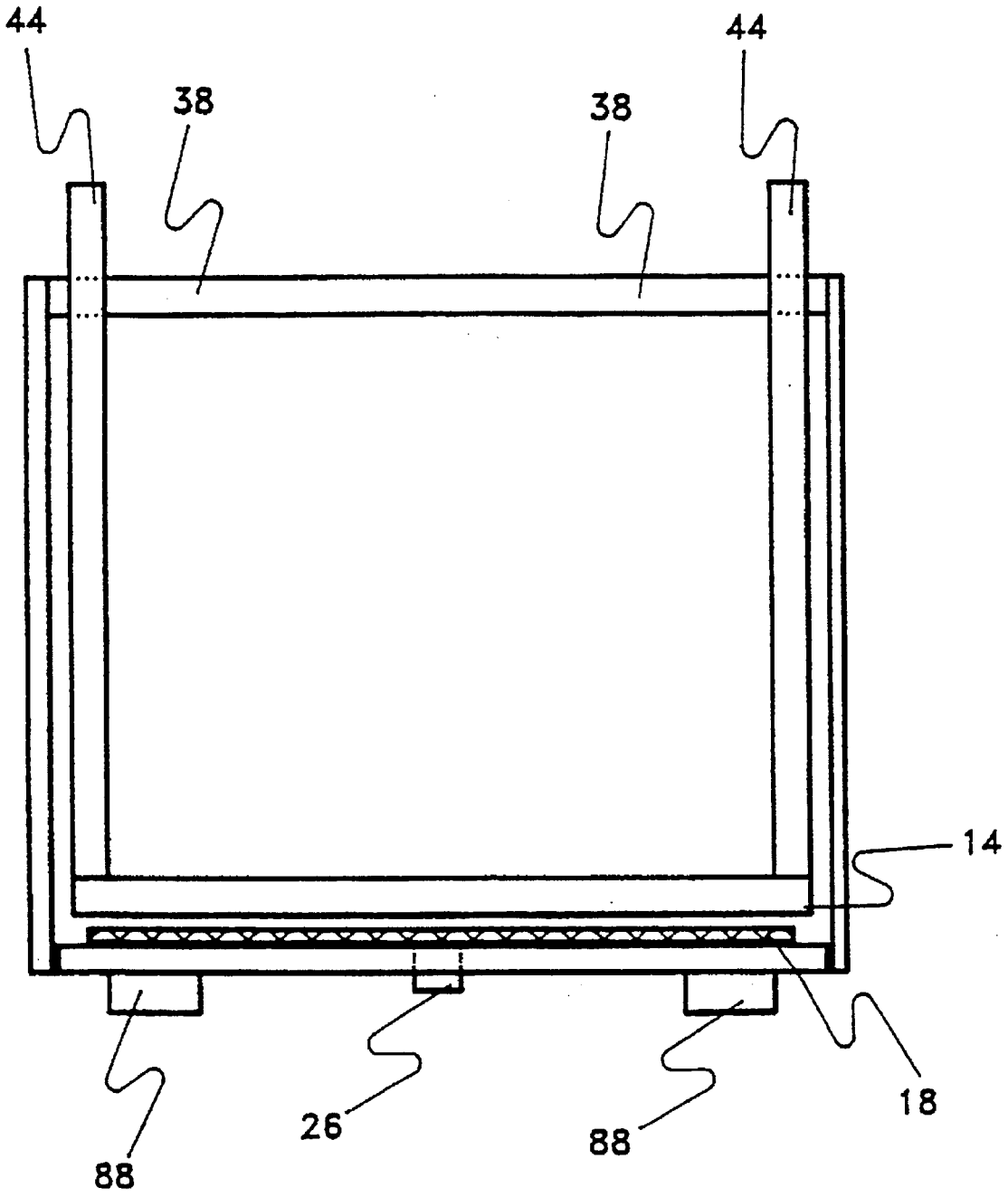
FIG. 9 shows an end view of the unloading apparatus adapted to fit a fork lift truck according to the invention.

FIG. 9 shows an end view of the unloading apparatus adapted to fit a fork lift truck according to the invention. In this embodiment, the base frame may be flat with no legs. The forks of the fork lift truck are inserted in lifting guideways 88. Lifting supports 44 and vertical supports 38 could be fabricated to be removal or foldable so that the entire apparatus could be stored in a space only a few inches high when not in use. Also, detachable legs, well known in the art, could be provided so that this embodiment would provide the same type of support arrangement shown in FIG. 1.

Figure 10:
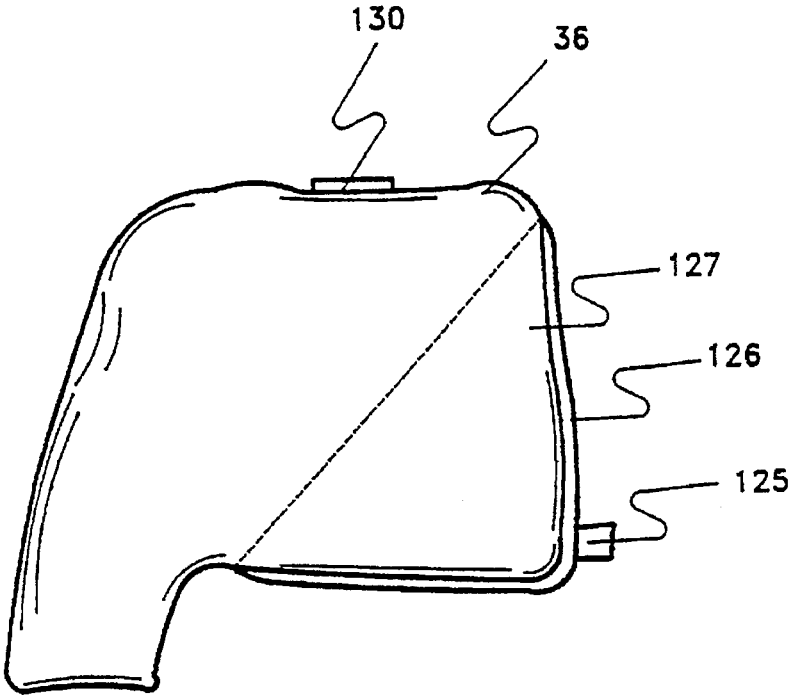
FIG. 10 is a side view of an alternative embodiment of the bulk bag apparatus in an opened position with an inflatable liner.

FIG. 10 is a side view of an alternative embodiment of the bulk bag apparatus in an opened position with an inflatable liner. To assist in breaking up severely caked material, as well as to discharge the material, an inflatable liner 126 is located inside the bag 36.

Figure 11:
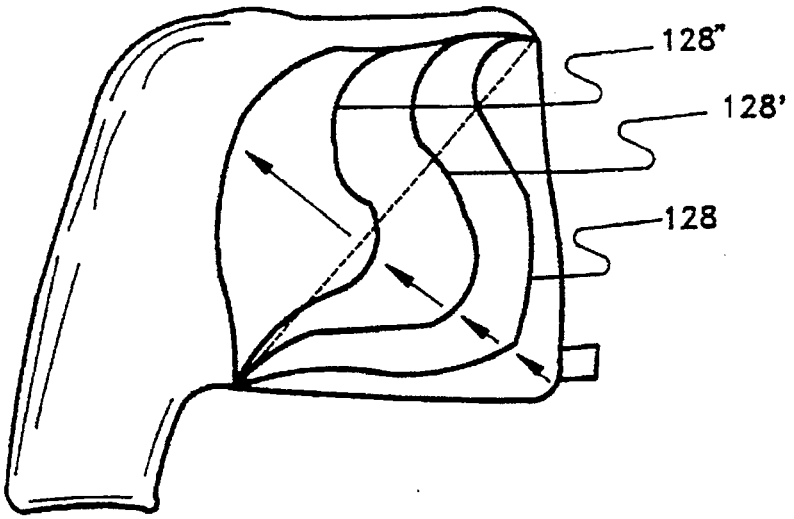
FIG. 11 is a side view of the alternative embodiment of the bulk bag apparatus showing the liner at various inflated positions during the unloading process.

FIG. 11 is a side view of the alternative embodiment of the bag 36 showing the liner 126 at various inflated positions 128–128" during the unloading process. The control system operates the liner in the same manner as the platform of the unloader is inclined. Instead of tilting the platform to discharge the material by use of the air bag, the liner 126 is inflated via inlet 125 inside the bag to 128, 128' and 128" until the bag is unloaded. As part of the invention, an air inlet assembly is provided on the bag to inflate the liner. A safety, pressure-relief exhaust port (not shown) may also be used. This port should be designed to release well below the rupture point of the inflatable liner. The advantage of this design is that the bag never moves during discharge. Any flat surface can be used as the bag platform. When using the standard controls, a check valve does not have to be used. The delfation action provides extra movement in the bag to help break up and fracture the material remaining in the bag.

This feature or embodiment of the invention greatly enhances the system's ability to handle a much wider range of poor flowing materials. For materials that can actually form a solid brick inside the bag, the dumping system is ineffective. The dumping system has no ability, except gravity, for breaking up the brick of material. If desired the inflatable liner and dumping can be used in combination.

A section of the bag, preferably at the top, can be fitted with a dust cloth material or dust vent opening 130. This allows the trapped air in the bag to escape when the bag is folded up for shipment back to the customer for refilling. A rigid closure assembly may be used on the top fill opening.

Figure 12:
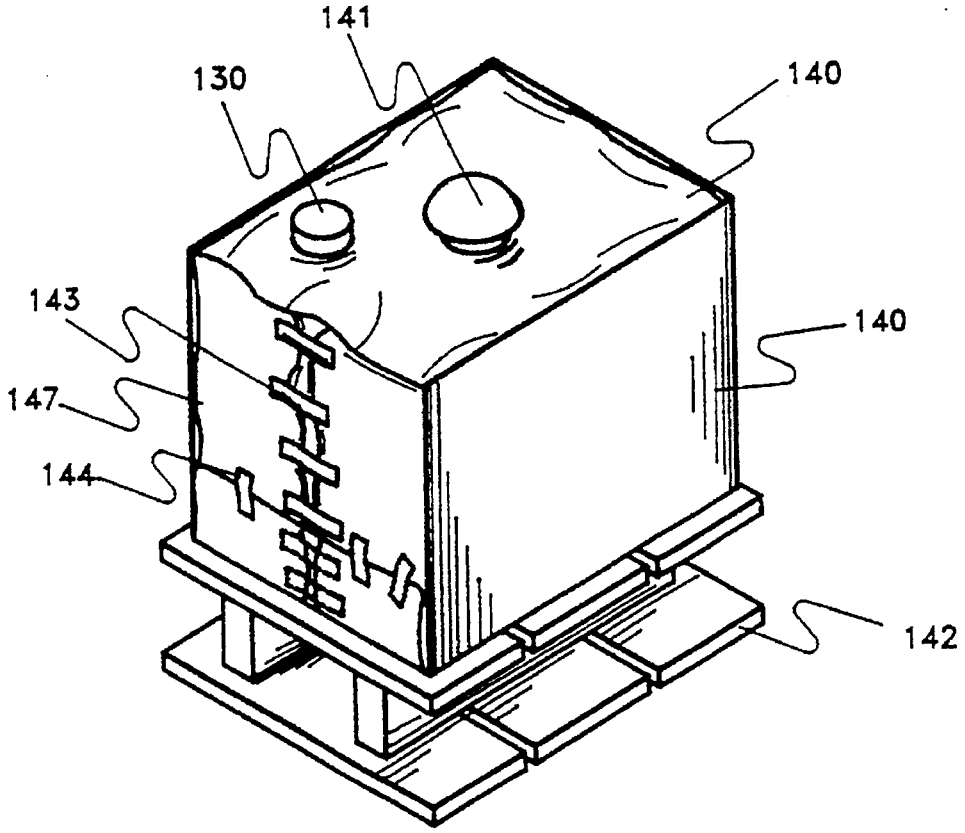
FIG. 12 is another alternative embodiment of the bulk bag apparatus having rigid sides, top and bottom.

FIG. 12 is another alternative embodiment of the bulk bag apparatus having one or more rigid sides. In this embodiment, all of the features discussed above may be used with a non-flexible container having rigid side and top walls 140 and a pallet-type bottom 142. The use of a rigid bottom 142 would permit easy handling of the unit. Also, fill opening 141 would similarly be rigid. Also, a rigid dust vent opening 130 can be fitted with a cloth material to act as a filter. Fabric wall 147 may be fitted with a side discharge pleated opening releasably held with restraining straps 143 with the mouth restrained by straps 144. This embodiment could also be equipped with an inflatable liner design as discussed in FIGS. 10 and 11 or utilize the inclining platform device discussed above.

Figure 13:
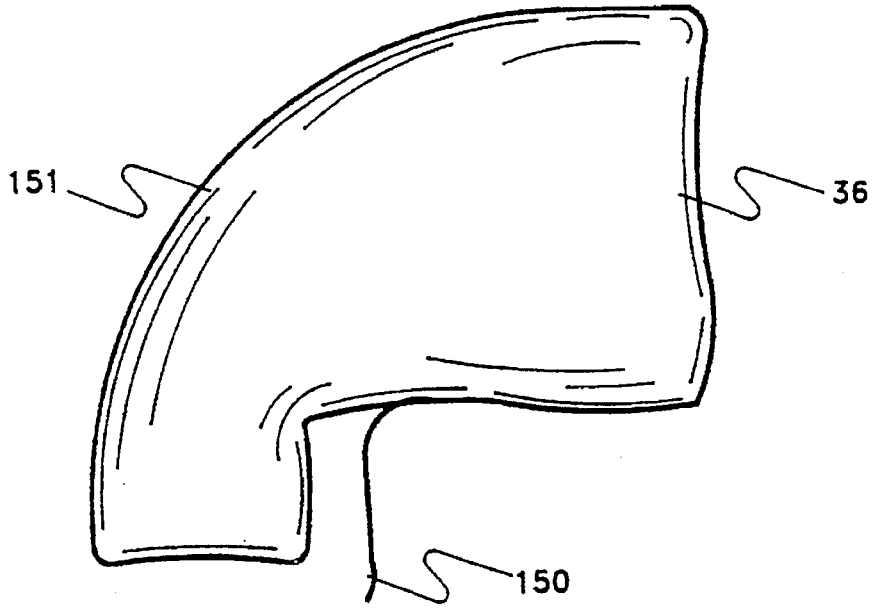
FIG. 13 is a side view of the bulk bag apparatus shown with a separate flap to hold and protect the spout section of the bag.

FIG. 13 is a side view of the bulk bag apparatus shown with a separate flap 150 to hold and protect the spout section 151 of bag 36.

Figure 14:
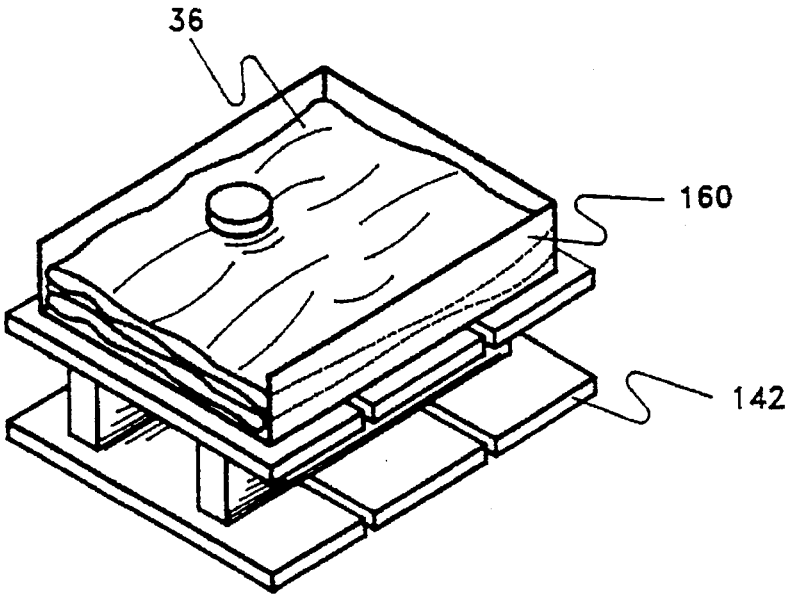
FIG. 14 is an isometric view of the folded bag having a pallet bottom with a protective side enclosure.

FIG. 14 is an isometric view of the folded bag 36 having a pallet bottom 142 with a protective side enclosure 160. Protective enclosure 160 ensures that bag 36 is not damaged when in the folded position and stacked one upon the other for storage.

Figure 15:
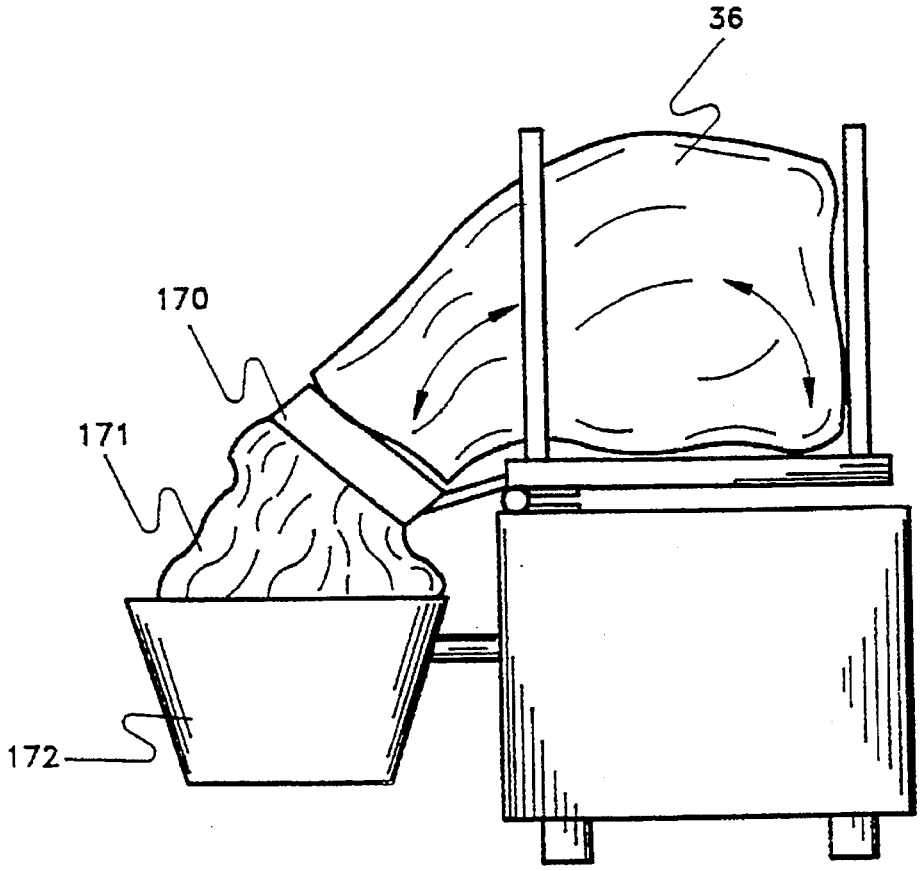
FIG. 15 is a side view of the bulk bag apparatus and unloading apparatus with a bag connection flange in place.

FIG. 15 is a side view of the bulk bag apparatus 36 and unloading apparatus 14 with a bag connection flange 170 in place. When apparatus 14 inclines, bag 36 may exhibit a tendency to bunch up in the spout region of bag 36. By adding a rigid spout, flange 170 connected to a flexible intermediate spout 171, the problem is solved. While spout 171 does fold as the apparatus inclines, it does not interfere with the flow of material.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A dry bulk material containment receptacle comprising:

a polyhedral shaped enclosure having substantially planar top and bottom panels and at least one side panel connected between said top and bottom panels, said panels constructed from a flexible material selected in accordance with the dry bulk material to be contained therein; said top panel having a closable opening through which said enclosure can be filled with the dry bulk material; and discharge spout means for discharging the dry bulk-material that can be contained within said enclosure, attached to said side panel adjacent to said bottom panel.

2. The bulk containment receptacle of claim 1 further comprising:

straps to hold said receptacle on a frame and lift it.

3. The dry bulk containment receptacle of claim 1, further comprising fastening means attached to said polyhedral shaped enclosure near a side of said bottom panel opposite said discharge spout means for restricting sliding movement of said polyhedral shaped enclosure.

4. The dry bulk containment receptacle as in claim 3, wherein said fastening means are taken from a group consisting of straps and loops.

5. The bulk containment receptacle of claim 1 further comprising an inflatable liner that can be inflated with air to cause the material contained within said bag to be released via said discharge spout means for discharge.

6. The bulk containment receptacle of claim 5 wherein said receptacle further comprises a pressure relief device that is designed to release when the pressure in said inflatable liner exceeds a predetermined limit.

7. The bulk containment receptacle of claim 5, further comprising at least one air inlet port pneumatically connected to the inflatable liner and protruding out of the bulk containment receptacle.

8. The bulk containment receptacle of claim 1 further comprising:

pleating means said side panel that enables the volumetric capacity of said receptacle to be substantially constant during filling and storage whereupon said pleating means can be released during discharge to increase the volumetric capacity of said receptacle wherein the discharge of the contents of said receptacle is facilitated.

9. The bulk containment receptacle of claim 8 further comprising a rigid base having sufficient strength to enable said apparatus to be transported via a forklift when said apparatus is filled.

10. The bulk containment apparatus of claim 9 further comprising a sidewall enclosure to protect said apparatus when it is folded on said rigid base and at least one other said apparatus is stacked upon it.

11. The bulk containment receptacle of claim 1 wherein said discharge means for discharge further comprises a discharge spout having an entrance, an exit, top and bottom, with the top integral with the side panel and the bottom integral with the bottom panel, with the entrance of said spout being folded closed by releasably attaching the exit of said spout against said side panel during filling and storage.

12. The bulk containment receptacle of claim 11, further comprising at least one hook and loop fastener secured to the spout and side panel for releasably attaching the exit of the spout against the side panel.

13. The bulk containment receptacle of claim 12, wherein said fastener is a "VELCRO" hook and loop fastener.

14. A dry bulk material containment apparatus comprising:

a polyhedral shaped enclosure having substantially rigid planar top and bottom panels and at least one side panel connected between said top and bottom panels, said panel constructed from a flexible material selected in accordance with the dry bulk material to be contained therein; said top panel having a closable opening through which said enclosure can be filled with the dry bulk material; and discharge spout means for discharging the dry bulk material that can be contained within said enclosure, attached to said side panel adjacent to said bottom panel.

15. The dry bulk containment apparatus of claim 14, further comprising fastening means attached to said polyhedral shaped enclosure near a side of said bottom panel opposite said discharge spout means for restricting sliding movement of said polyhedral shaped enclosure.

16. The dry bulk containment apparatus as in claim 15, wherein said fastening means are taken from a group consisting of straps and loops.

17. The bulk containment apparatus of claim 14 further comprising:

pleating means said flexible side panel that enables the volumetric capacity of said apparatus to be substantially constant during filling and storage whereupon said means for pleating can be released during discharge to increase the volumetric capacity of said apparatus wherein the discharge of the contents of said apparatus is facilitated.

18. The bulk containment apparatus of claim 17 wherein said discharge spout means for discharge further comprises a discharge spout having an entrance, an exit, top and bottom, with the top integral with the side panel and the bottom integral with the bottom panel, with the entrance of said spout being folded closed by releasably attaching the exit of said spout against said side panel during filling and storage.

19. The bulk containment apparatus of claim 18 further comprising an inflatable liner that can be inflated with air to cause the material contained within said apparatus to be released via said means for discharge.

20. The bulk containment apparatus of claim 19 wherein said apparatus further comprises a pressure relief device that is designed to release when the pressure in said inflatable liner exceeds a predetermined limit.

21. A dry bulk material containment receptacle comprising:

a polyhedral shaped enclosure having substantially planar top and bottom panels and at least one side panel connected between said top and bottom panels, said panel constructed from a flexible material selected in accordance with the dry bulk material to be contained therein; said top panel having a closable opening through which said enclosure can be filled with a dry bulk material; and discharge spout means for discharging the dry bulk material that can be contained within said enclosure, attached to said side panel adjacent to said bottom panel; wherein said discharge spout means for discharge represents at least 10% of the total volume of said bag; and fastening means attached to said polyhedral shaped enclosure near a side of said bottom panel opposite said discharge spout means for restricting sliding movement of said polyhedral shaped enclosure.

22. The dry bulk containment receptacle as in claim 21, wherein said fastening means are taken from a group consisting of straps and loops.

* * * * *